US007157868B2

(12) United States Patent
Brown et al.

(10) Patent No.: US 7,157,868 B2
(45) Date of Patent: Jan. 2, 2007

(54) LINEAR ACCELERATOR

(75) Inventors: Kevin John Brown, West Sussex (GB); Terry Arthur Large, West Sussex (GB); Wei Yu, East Grinstead (GB)

(73) Assignee: Elekta AB, Stockholm (SE)

( * ) Notice: Subject to any disclaimer, the term of this patent is extended or adjusted under 35 U.S.C. 154(b) by 15 days.

(21) Appl. No.: 11/194,886

(22) Filed: Aug. 1, 2005

(65) Prior Publication Data

US 2006/0202644 A1 Sep. 14, 2006

(30) Foreign Application Priority Data

Mar. 12, 2005 (GB) ..... 0505090.1

(51) Int. Cl.
*H05H 9/00* (2006.01)

(52) U.S. Cl. ..... 315/505; 315/500

(58) Field of Classification Search ..... 315/500, 315/505, 506, 5.41–5.47; 250/396 R, 492.23
See application file for complete search history.

(56) References Cited

U.S. PATENT DOCUMENTS 4,286,192 A * 8/1981 Tanabe et al. ..... 315/5.41
4,400,650 A * 8/1983 Giebeler, Jr. ..... 315/5.41
4,629,938 A * 12/1986 Whitham ..... 315/5.41
4,746,839 A * 5/1988 Kazusa et al. ..... 315/5.41
5,401,973 A * 3/1995 McKeown et al. ..... 250/492.3

FOREIGN PATENT DOCUMENTS

GB 2354876 A 8/1999
GB 2334139 A 4/2001
GB 2354875 A 4/2001

* cited by examiner

*Primary Examiner*—Haissa Philogene
(74) *Attorney, Agent, or Firm*—Z. Peter Sawicki; Westman, Champlin & Kelly, P.A.

(57) ABSTRACT

A linear accelerator comprises a series of accelerating cavities, adjacent pairs of which are coupled via coupling cavities, in which at least one coupling cavity comprises a rotationally asymmetric element that is rotateable thereby to vary the coupling offered by that cavity. A control means for the accelerator is also provided, adapted to control operation of the accelerator and rotation of the asymmetric element, arranged to operate the accelerator in a pulsed manner and to rotate the asymmetric element between pulses to control the energy of successive pulses. A beneficial way of doing so is to rotate the asymmetric element continuously during operation of the linear accelerator. Then, the control means need only adjust the phase of successive pulses so that during the brief period of the pulse, the asymmetric element is "seen" to be at the required position. The asymmetric element can disposed within an evacuated part of the accelerator and rotated by way of an electromagnetic interaction with parts outside the evacuated part. No parts associated with the drive need therefore pass through the vacuum seal. This could be achieved by providing at least one magnetically polarized member on the asymmetric element and at least one electrical coil outside the evacuated part.

8 Claims, 4 Drawing Sheets

LINEAR ACCELERATOR

The present application claims priority of United Kingdom patent application Serial No. 0505090.1, filed Mar. 12, 2005, the content of which is hereby incorporated by reference in its entirety.

FIELD OF THE INVENTION

The present invention relates to a linear accelerator ("linac")

BACKGROUND ART

In the use of radiotherapy to treat cancer and other ailments, a powerful beam of the appropriate radiation is directed at the area of the patient that is affected. This beam is apt to kill living cells in its path, hence its use against cancerous cells, and therefore it is highly desirable to ensure that the beam is correctly aimed. Failure to do so may result in the unnecessary destruction of healthy cells of the patient.

Several methods are used to check this, and devices such as the Elekta™ Synergy™ device employ two sources of radiation, a high energy accelerator capable of crating a therapeutic beam and a lower energy X-ray tube for producing a diagnostic beam. Both are mounted on the same rotatable gantry, separated by 90°. Each has an associated flat-panel detector, for portal images and diagnostic images respectively.

In our earlier application WO-A-99/40759, we described a novel coupling cell for a linear accelerator that allowed the energy of the beam produced to be varied more easily than had hitherto been possible. In our subsequent application WO-A-01/11928 we described how that structure could be used to produce very low energy beams, suitable for diagnostic use, in an accelerator that was also able to produce high-energy therapeutic beams. The disclosure of both of these prior disclosures is hereby incorporated by reference. The reader should note that this application develops the principles set out in those applications, which should therefore be read in conjunction with this application and whose disclosure should be taken to form part of the disclosure of this application.

SUMMARY OF THE INVENTION

The Elekta™ Synergy™ arrangement works very well, but requires some duplication of parts in that, in effect, the structure is repeated to obtain the diagnostic image. In addition, care must be taken to ensure that the two sources are in alignment so that the diagnostic view can be correlated with the therapeutic beam. However, this has been seen as necessary so that diagnostic images can be acquired during treatment to ensure that the treatment is proceeding to plan.

WO-A-01/11928 shows how the accelerator can be adjusted to produce a low-energy beam instead of a high-energy beam, but does not detail how the two beams could be produced simultaneously as is required for concurrent therapy and monitoring. Typically, in known variable energy linacs the electron beam energy defining mechanism is set to a particular value, the linac is run at that value for a certain duration, and then the energy is changed to a different setting. In general to achieve a therapeutic energy it is necessary to operate the accelerator in a pulsed manner, this enables very high peak rf powers to be achieved while the equipment consumes moderate mean power.

The present invention therefore provides a linear accelerator, comprising a series of accelerating cavities, adjacent pairs of which are coupled via coupling cavities, in which at least one coupling cavity comprises a rotationally asymmetric element that is rotatable thereby to vary the coupling offered by that cavity. A control means for the accelerator is also provided, adapted to control operation of the accelerator pulses and rotation of the asymmetric element, arranged such that pulses occur at controlled angles of the asymmetric element to control the energy of successive pulses. It is therefore possible to vary the energy from one pulse to the next if so desired.

A beneficial way of doing so is to rotate the asymmetric element continuously during operation of the linear accelerator. Then, the control means need only adjust the phase of successive pulses so that during the brief period of the pulse, the asymmetric element is "seen" to be at the required position. The pulse rate of the accelerator can be nominally the same as the rotation speed of the asymmetric element, but if the latter has some degree of rotational symmetry although not perfect rotational symmetry), then the rotation speed can be set at 1/n times the pulse rate, where n is the degree of rotation symmetry. Thus, in cases such as WO-A-99/40759 where the asymmetric element is a flat vane, it will have a rotational symmetry of 2 (indicating that the a half-rotation will leave it in a substantially indistinguishable state) and the rotation speed can be one half of the pulse rate.

Some angles of the asymmetric element are less reliable than others in practice. Thus, it is preferred that the control means includes a mechanism to prevent operation of the accelerator when the asymmetric element is in certain orientations.

In general, the impedance of the accelerator can vary with the coupling of the cells that is contains. This can be dealt with if the control means is arranged to adjust the power of rf feed to the accelerator in dependence on the angle of the asymmetric element at the moment of the rf pulse.

A major advantage of the arrangement of WO-A-99/40759 is that a rotational coupling is very much easier in the context of an evacuated apparatus. Indeed, in the context of a continuously rotating devices, further possibilities arise. A shaft could be passed through the vacuum seal. However, we prefer an arrangement in which the asymmetric element is disposed within an evacuated part of the acceleration and is rotated by way of an electromagnetic interaction with parts outside the evacuated part. No parts associated with the drive need therefore pass through the vacuum seal. This could be achieved by providing at least one magnetically polarized member on the asymmetric element and at least one electrical coil outside the evacuated part. Such arrangements are employed in the field of stepper motors, although not (to our knowledge) through a vacuum seal.

BRIEF DESCRIPTION OF THE DRAWINGS

An embodiment of the present invention will now be described by way of example, with reference to the accompanying figures in which.

DETAILED DESCRIPTION OF THE EMBODIMENTS

There would be distinct clinical advantages in a machine whose beam energy can be switch effectively 'instantaneously' from a therapeutic energy to an imaging energy, to allow imaging during therapy but with no overhead in time and utilizing a much simpler construction.

Figure 1:
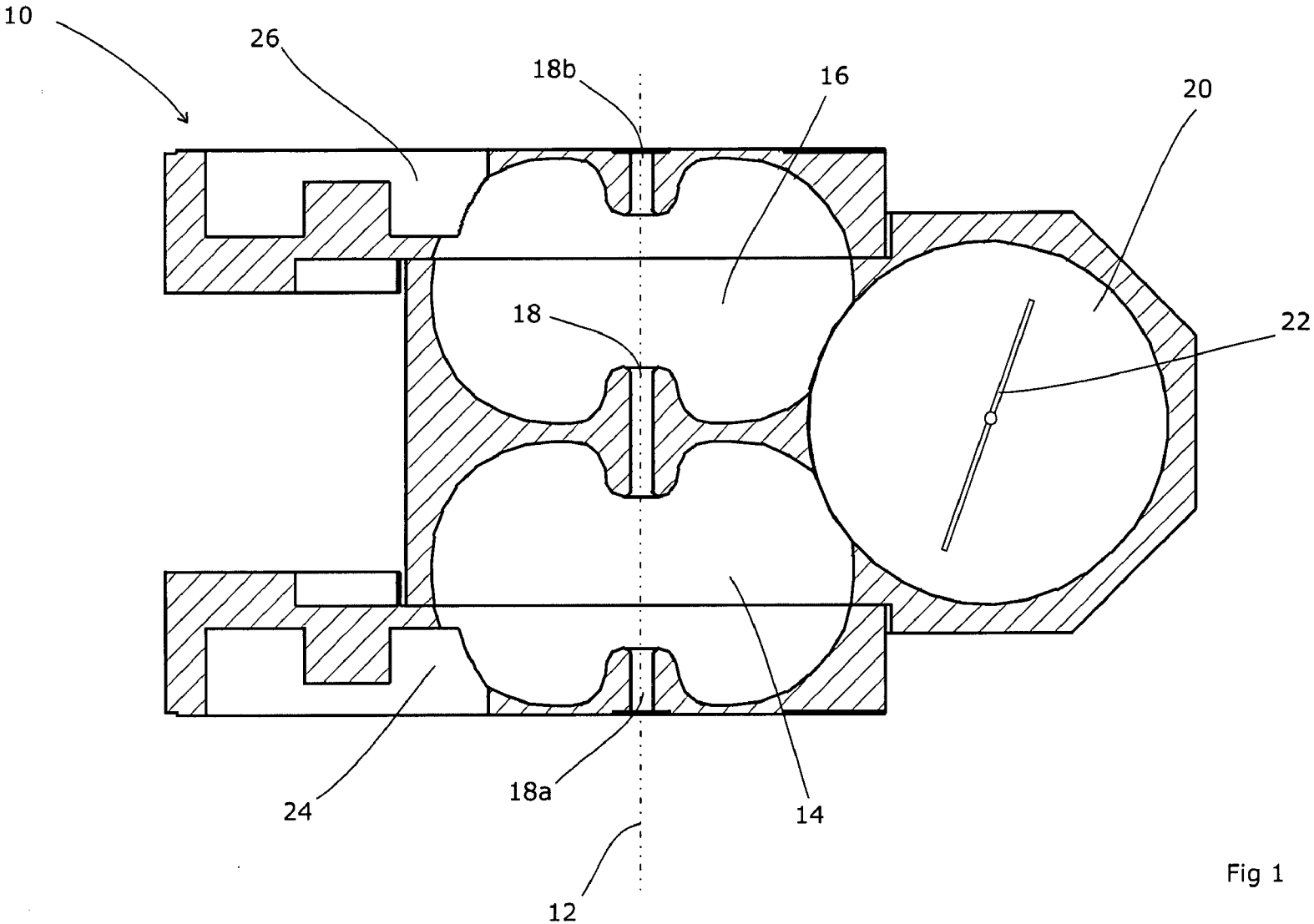
FIG. 1 shows a view of a pair of accelerator cavities and the coupling cavity between them.

FIG. 1 shows the coupling cavity of the linac 10 disclosed in WO-A-99/40759. A beam 12 passes from an '$n^{th}$' accelerating cavity 14 to an '$n+1^{th}$' cavity 16 via an axial aperture 18 between the two cavities. Each cavity also has a half-aperture 18*a* and 18*b* so that when a plurality of such structures are stacked together, a linear accelerator is produced.

Each adjacent pair of accelerating cavities can also communicate via "coupling cavities" that allow the radiofrequency signal to be transmitted along the linac and thus create the standing wave that accelerates electrons. The shape and configuration of the coupling cavities affects the strength and phase of the coupling. The coupling cavity 20 between the $n^{th}$ and the $n+1^{th}$ cavities is adjustable, in the manner described in WO-A-99/40759, in that it comprises a cylindrical cavity in which is disposed a rotatable vane 22. As described in WO-A-99/40759 and WO-A-01/11928 (to which the skilled reader is referred), this allows the strength and phase of the coupling between the accelerating cells to be varied by rotating the vane, as a result of the rotational asymmetry thereof.

It should be noted that the vane is rotationally asymmetric in that a small rotation thereof will result in a new and non-congruent shape to the coupling cavity and "seen" by the rf signal. A half-rotation of 180° will result in a congruent shape, and thus the vane has a certain degree of rotational symmetry. However, lesser rotations will affect coupling and therefore the vane does not have complete rotational symmetry; for the purposes of this invention it is therefore asymmetric.

The $n^{th}$ accelerating cavity 14 is coupled to the $n-1^{th}$ by a fixed coupling cell. That is present in the structure illustrated in FIG. 1 as a half-cell 24. This mates with a corresponding half-cell in the adjacent structure. Likewise, the $n+1^{th}$ accelerating cell 16 is coupled to the $n+2^{th}$ such cell by a cell made up of the half-cell 26 and corresponding half-cell in an adjacent structure.

The radiation is typically produced from the linac in short pulses of about 3 microseconds, approximately every 2.5 ms. To change the energy of a known linac, be that by way of the rotateable vane described above of by other previously known means, the linac is switched off, the necessary adjustment is made, and the linac is re-started.

According to the invention, the rotatable vane 22 is caused to continuously rotate with a period correlated to the pulse rate of the linac. Thus, in this example the period is 2.5 ms i.e. 400 revolutions per second or 24,000 rpm. The radiation is then produced at a particular position of the vane or a particular phase of the rotation. Given that the linac is active for only 0.12% of the time, the vane will (at most) rotate through slightly less than half a degree and thus will be virtually stationary as "seen" by the rf signal.

This phase of the linac's pulse can be easily changed from one pulse to the next. This therefore allows the energy to be switched from one pulse to the next, since changing the phase correlates with the selection of a different vane angle.

In the adjustable coupling cell 20, the electric fields are symmetrical on either side of the vane. It therefore follows that the vane spin speed can in fact be reduced by a factor of 2 compared to that a suggested above, which allows a lesser spin speed of 12,000 rpm to be adopted.

Figure 2:
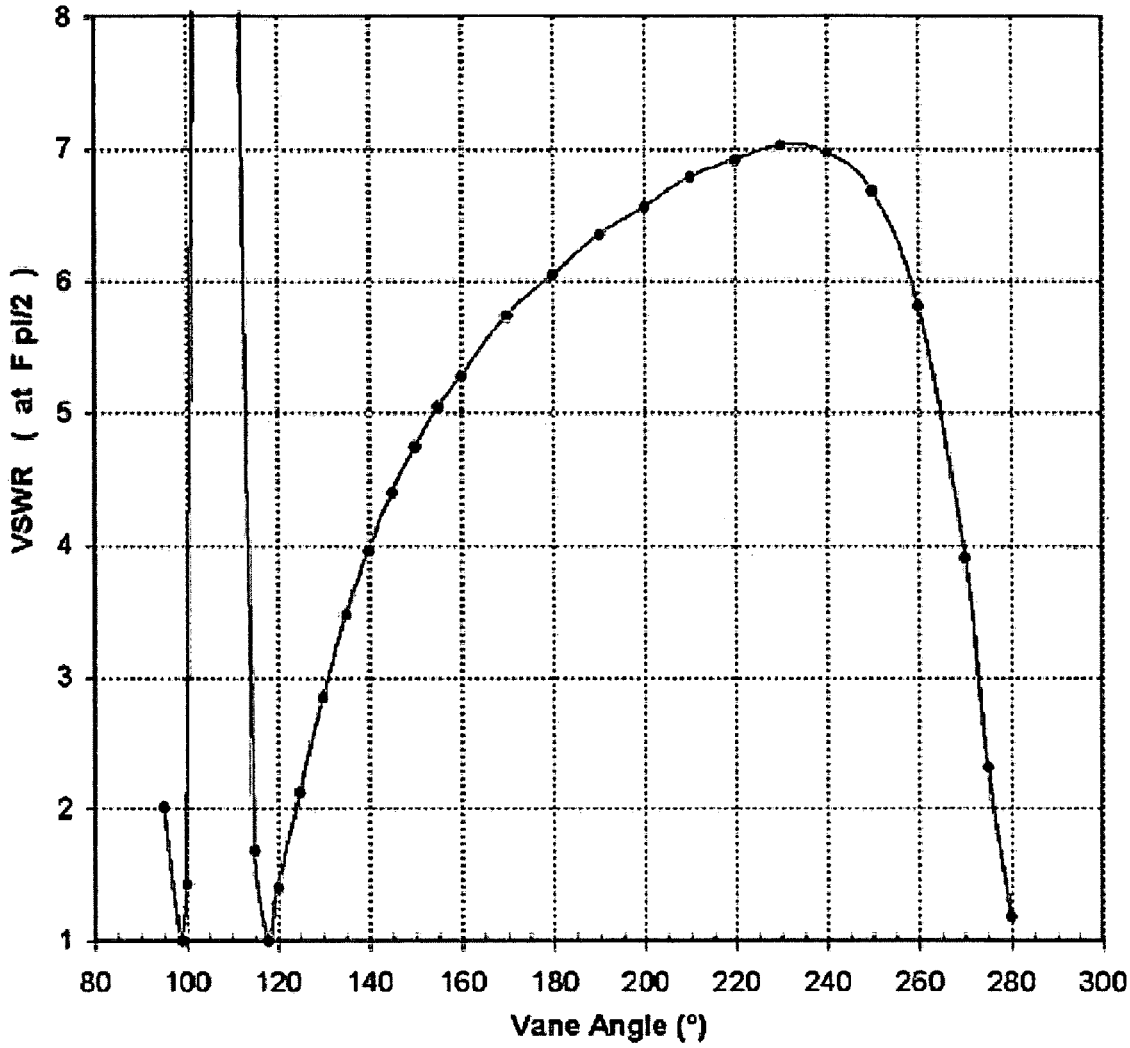
FIGS. 2 and 3 show characteristic curves for the accelerator, FIG. 2 showing the variation in linac impedance with vane angle.

FIG. 2 illustrates a practical aspect of the use of such a system. As may be seen in the Voltage Standing Wave Ratio (VSWR) vs vane angle plot, there are two "danger zones" in the angle ranges of 100°–120° and 280°–300°, in which the waveguide is under coupled. They should be avoided, by use of a suitable control mechanism.

Figure 3:
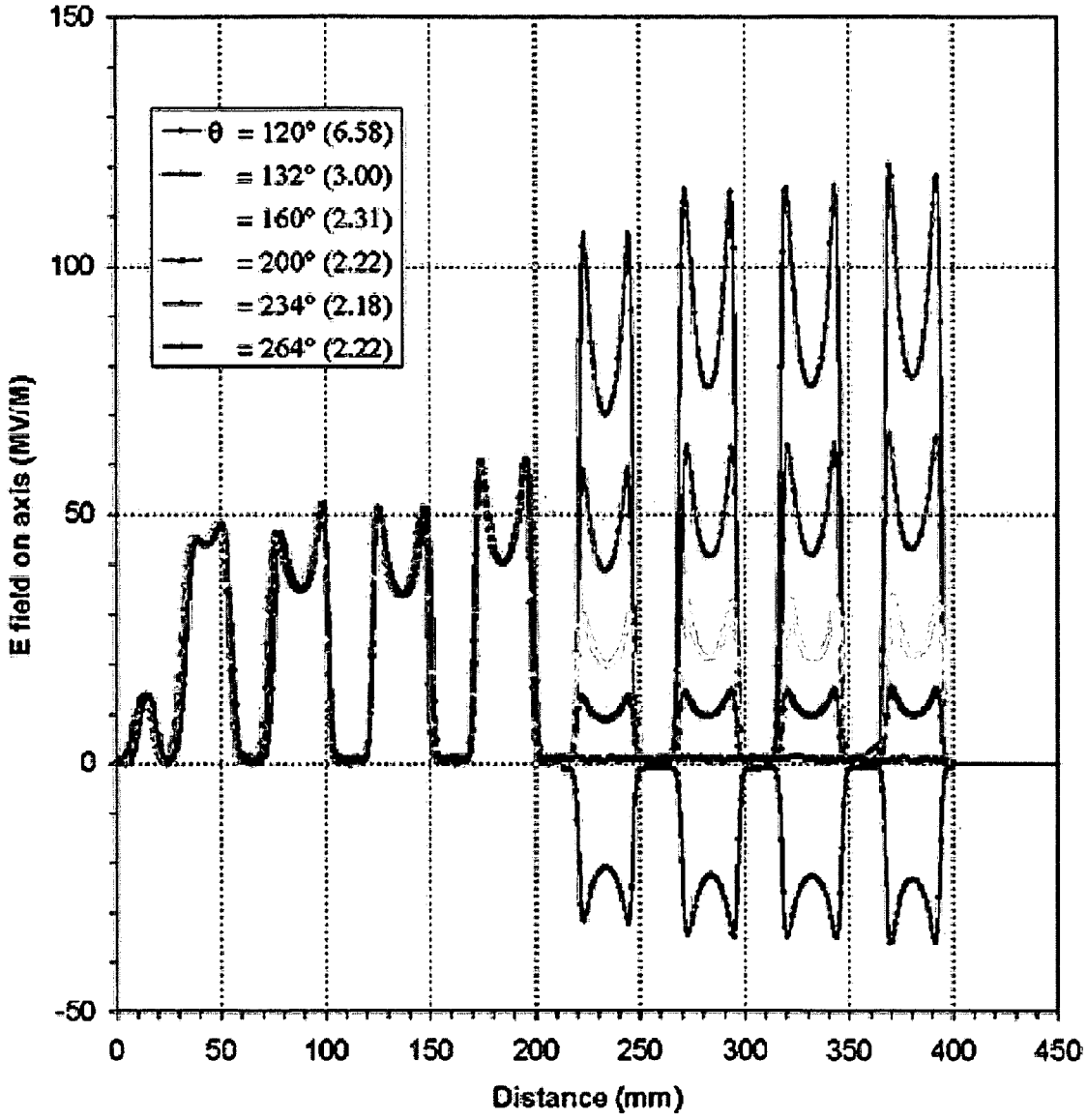

Within the working range of 120° to 280°, there are benefits in adjusting the input power according to the vane angle, to maintain the electric field constant. This is mainly due to the fact that the VSWR of the whole waveguide changes with the vane angle. FIG. 3 shows the input power required (in brackets) at different angles, together with the varying electrical field developed after the adjustable coupling cell at 200 mm along the linac. These varying electric fields translate into a varying energy of the electrons produced by the linac. Note that at 264° the electric field after the adjustable coupling cell is reversed; this decelerates the electrons and results in a very low diagnostic energy as described in WO-A-01/11928.

This idea can also be used to servo the actual energy of the beam to take account of variations in other systems.

The ability to vary the energy pulse to pulse could be used to control the depth dose profile pulse to pulse. This could be of benefit on a scanned beam machine where the ability to vary the energy across the radiation field could be used to produce less rounded isodose lines in the X-Z and Y-Z directions.

A further advantage of being able to vary the energy so rapidly would be to vary the therapy beam energy when in electron mode, thereby extending the irradiated volume receiving 100% of the dose.

Figure 4:
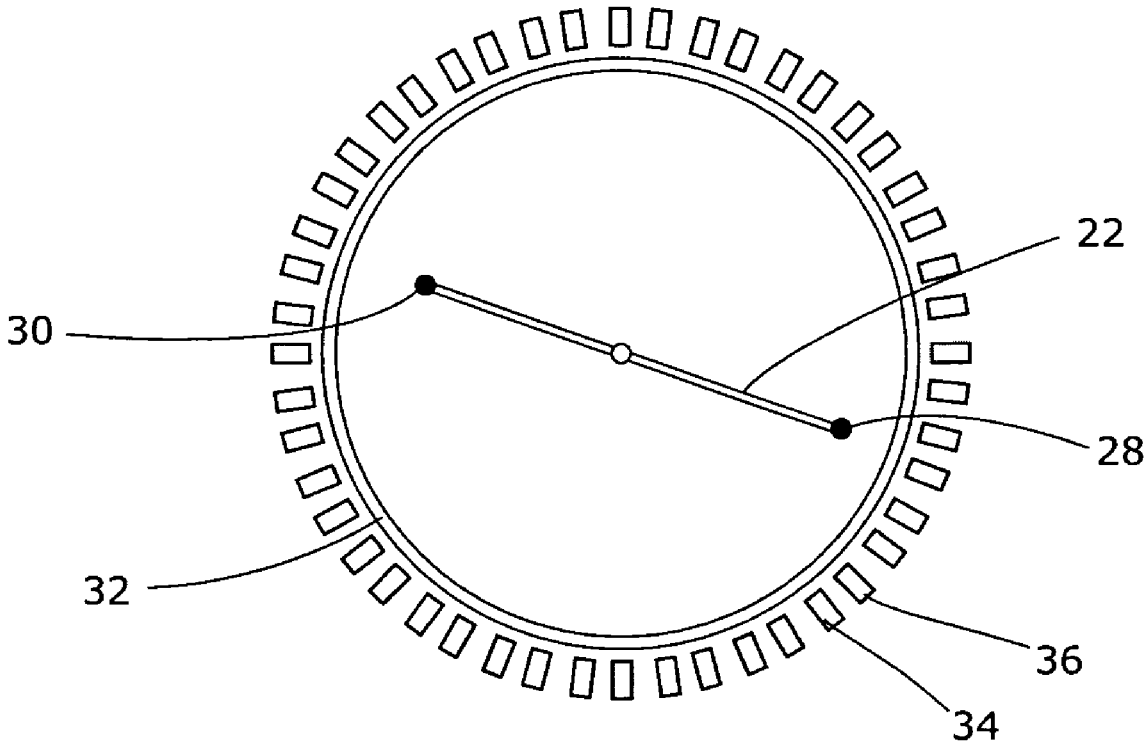
FIG. 4 shows an arrangement for rotating the asymmetric element.

FIG. 4 shows a possible mechanism by which the vane 22 can be rotated continuously. The vane does of course sit in an evacuated volume, so evidently a suitable shaft could be provided, with appropriate sealing, to transmit rotation from a motor outside the evacuated volume. Alternatively, as shown illustratively in FIG. 4, a magnetic control system could be provided. In this arrangement, the vane 22 is provided with magnetically polarised sections 28, 30 on either end. Then, outside the vacuum seal 32, an array of electrical coils 34, 36 etc are provided. These can then interact with the polarised section 28, 30 in the manner of a stepper motor.

It will of course be understood that many variations may be made to the above-described embodiment without departing from the scope of the present invention. For example, the arrangement of FIG. 4 could be applied to the vane itself or to a separate structure set to one side and away from the coupling cells. Such a device could transmit rotational torque to the vane via a shaft lying entirely within the evacuated volume, thereby keeping the magnetic fields of the motor away from the linac without needing to transmit rotation through the vacuum seal.

The invention claimed is:

1. A linear accelerator, comprising;

a series of accelerating cavities, adjacent pairs of which are coupled via coupling cavities;

at least one coupling cavity comprising a rotationally asymmetric element that is rotatable and thereby to vary the coupling offered by that cavity;

a control means for the accelerator, adapted to control operation thereof and control rotation of the asymmetric element;

the control means being arranged to operate the accelerator in a pulsed manner and to rotate the asymmetric element between pulses to control the energy of successive pulses.

2. A linear accelerator according to claim 1 in which rotation of the asymmetric element is continuous during operation of the linear accelerator.

3. A linear accelerator according to claim 2 in which the control means adjusts the phase of successive pulses with respect to the angle of the asymmetric element.

4. A linear accelerator according to claim 2 in which the pulse rate of the accelerator is substantially twice the rotation rate of the asymmetric element.

5. A linear accelerator according to claim 1, in which the control means includes a control mechanism to prevent operation of the accelerator when the asymmetric element is in certain orientations.

6. A linear accelerator according to claim 1, in which the control means is arranged to adjust the power of rf feed to the accelerator in dependence on one of the angle of the asymmetric element and the phase of the pulse.

7. A linear accelerator according to claim 1, in which the asymmetric element is disposed within an evacuated part of the accelerator and is rotated by way of an electromagnetic interaction with parts outside the evacuated part.

8. A linear accelerator according to claim 7 in which the magnetic interaction is between at least one magnetically polarised member on the asymmetric element and at least one electrical coil outside the evacuated part.

* * * * *